US005613695A

United States Patent [19]

Yu

[11] Patent Number: 5,613,695

[45] Date of Patent: *Mar. 25, 1997

[54] SKATE BOARD COMBINATION

[76] Inventor: Fu-Pin Yu, No. 20, Lane 426, Sec 2, Chong Der Road, Taichung, Taiwan

[ * ] Notice: The term of this patent shall not extend beyond the expiration date of Pat. No. 5,458,351.

[21] Appl. No.: 436,790

[22] Filed: May 8, 1995

[51] Int. Cl.[6] ..... B62B 9/04; A63C 5/06

[52] U.S. Cl. ..... 280/14.2; 280/606

[58] Field of Search ..... 280/14.1, 14.2, 280/15, 16, 17, 87.042, 619, 87.041

[56] References Cited

U.S. PATENT DOCUMENTS

| | | | |
|---|---|---|---|
| D. 338,253 | 8/1993 | Smith et al. | 280/87.042 X |
| 3,771,811 | 11/1973 | Bueno | 280/87.042 |
| 4,161,324 | 7/1979 | Colvin | 280/16 X |
| 4,202,559 | 5/1980 | Piazza, Jr. | 280/87.042 |
| 4,221,394 | 9/1980 | Campbell | 280/16 X |
| 4,811,971 | 3/1989 | Phillips | 280/87.041 |
| 4,955,626 | 9/1990 | Smith et al. | 280/87.042 |
| 5,147,234 | 9/1992 | Brug | 280/619 X |
| 5,249,816 | 10/1993 | Southworth | 280/16 X |
| 5,411,282 | 5/1995 | Shannon | 280/16 X |
| 5,458,351 | 10/1995 | Yu | 280/87.042 |

FOREIGN PATENT DOCUMENTS

| | | | |
|---|---|---|---|
| 1075477 | 2/1960 | Germany | 280/87.042 |
| 55282 | 1/1911 | Switzerland | 280/16 |
| 1405865 | 6/1988 | U.S.S.R. | 280/87.041 |

*Primary Examiner*—Brian L. Johnson
*Assistant Examiner*—Jonathan E. Butts
*Attorney, Agent, or Firm*—Charles E. Baxley, Esq.

[57] ABSTRACT

A ski board device includes a beam having two hubs disposed on the two ends. A pair of ski boards each includes a shaft extended upward and engaged upward through the hubs so as to allow free rotation in the hubs. A pair of foot supports secured on top of the shafts and rotated in concert with the shafts such that the foot suports are freely rotatable for changing the moving direction of the ski board device. Each of the foot supports includes an upwardly arched toe stirrup and a rearwardly arched heel stop for engagement with a foot of a user.

3 Claims, 3 Drawing Sheets

SKATE BOARD COMBINATION

BACKGROUND OF THE INVENTION

1. Field of the Invention

The present invention relates to a ski, and more particularly to a ski board combination that has rotary means for changing directions.

2. Description of the Prior Art

Typical skis comprise an integral ski board that has no rotary means for changing directions.

The present invention has arisen to mitigate and/or obviate the afore-described disadvantages of the conventional skis.

SUMMARY OF THE INVENTION

The primary objective of the present invention is to provide a ski board combination which includes rotary means for changing directions.

In accordance with one aspect of the invention, there is provided a ski board combination comprising a beam including two ends each having a hub provided thereon, and including a middle portion, a pair of ski boards each including a shaft extended upward therefrom and engaged upward through the hubs so as to allow free rotation in the hubs, and a pair of first foot supports secured on top of the shafts respectively and rotated in concert with the shafts, the first foot supports being freely rotatable relative to the beam.

Each first foot support includes an upwardly arched toe stirrup and a rearwardly arched heel stop secured thereon.

Each first foot support includes at least one slot formed therein, and each includes stop means engaged in the slot for engaging with the beam so as to limit rotational movement of the first foot supports.

A second foot support is provided above the middle portion of the beam, and a retaining means is provided on the middle portion of the beam for retaining the second foot support in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 4:
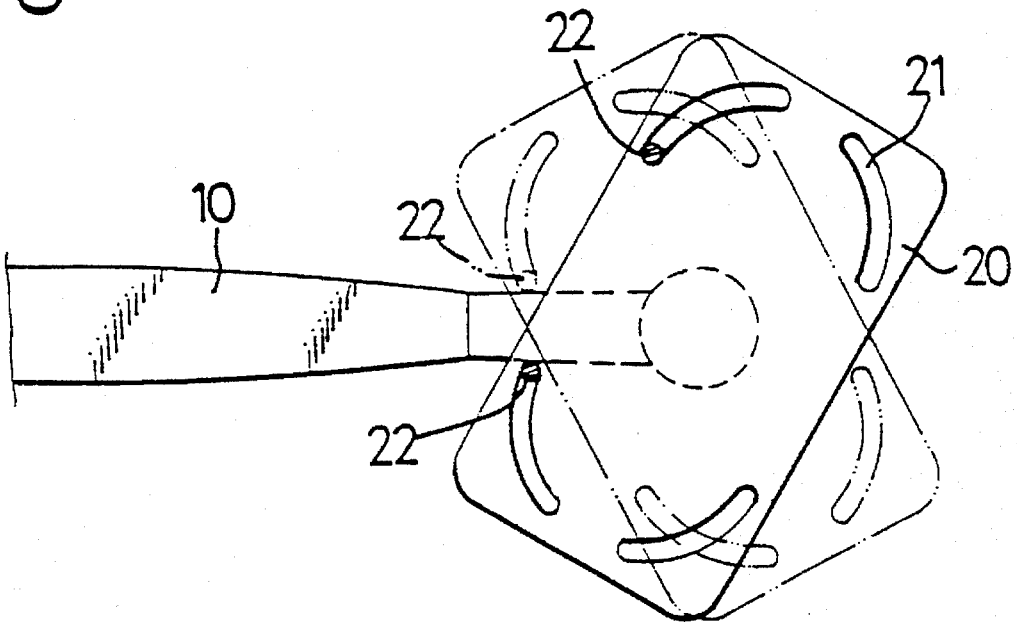
FIG. 4 is a partial plane view illustrating the operation of the ski board combination.

Referring to the drawings, a ski board combination in accordance with the present invention comprises a beam 10 including two hubs 11 provided on the end portions. Two ski boards 12 each includes a block 13 formed on the center portion and each includes a shaft 14 extended upward therefrom for engaging through the hubs 11. Reinforcing ribs 131 are provided between the blocks 13 and the ski boards 12 for reinforcing purposes. Bearing means 111 are engaged between the shaft 14 and the hub 11 for rotatably supporting the shaft 14 within the hub 11 such that the shafts 14 are freely rotatable about the hubs 11. Two foot supports 20 are secured on top of the shafts 14 and rotated in concert with the shafts 14. The foot supports 20 each includes two pairs of curved slots 21 for engaging with bolts 22 which are secured to the heel supports 20 by nuts 23. The bolts 22 may be secured to suitable positions along the curved slots 21 for engaging with the beam 10 so as to limit the rotational movement of the foot supports 20, best shown in FIG. 4. When the bolts 22 are disengaged from the foot supports 20, the foot supports 20 may freely rotate about the shaft 14.

An upwardly arched toe stirrup 24 and a rearwardly arched heel stop 25 are secured on top of each of the foot supports 20 for engaging with feet of the users. The upwardly arched toe stirrup 24 includes two ends 241 and the rearwardly arched heel stop includes two ends 251 engaged with screws 26 which are engaged through the holes 202 of the foot support 20 for securing the upwardly arched toe stirrup 24 and the rearwardly arched heel stop 25 on top of the foot supports 20. An inner layer 29 also includes two ends 291 for engaging with the screws 26. The inner layer 29 includes hook and loop device 292 for engaging with hook and loop device 242 of the stirrup 24 so as to be solidly secured to the stirrup 24. An outer layer 30 is engaged around the stirrup 24 and the inner layer 29 by hook and loop device for protecting the feet of the users.

Figure 1:
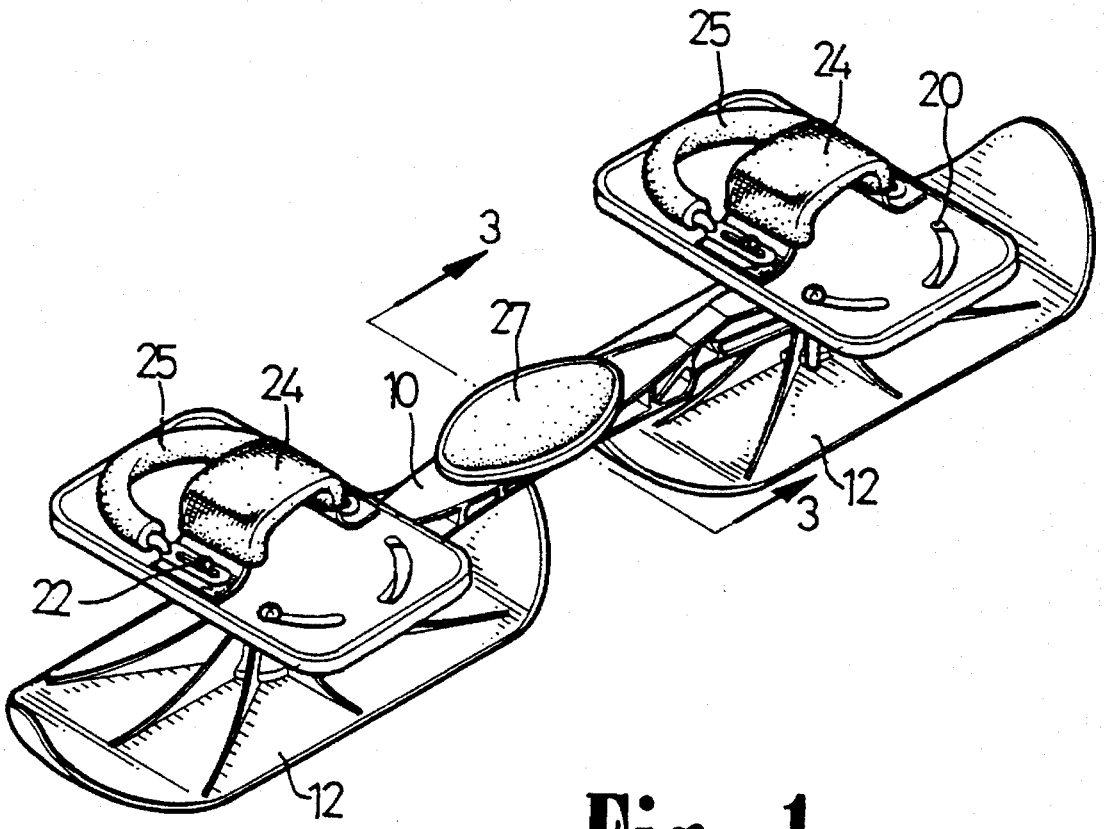
FIG. 1 is a perspective view of a ski board combination in accordance with the present invention.
Figure 2:
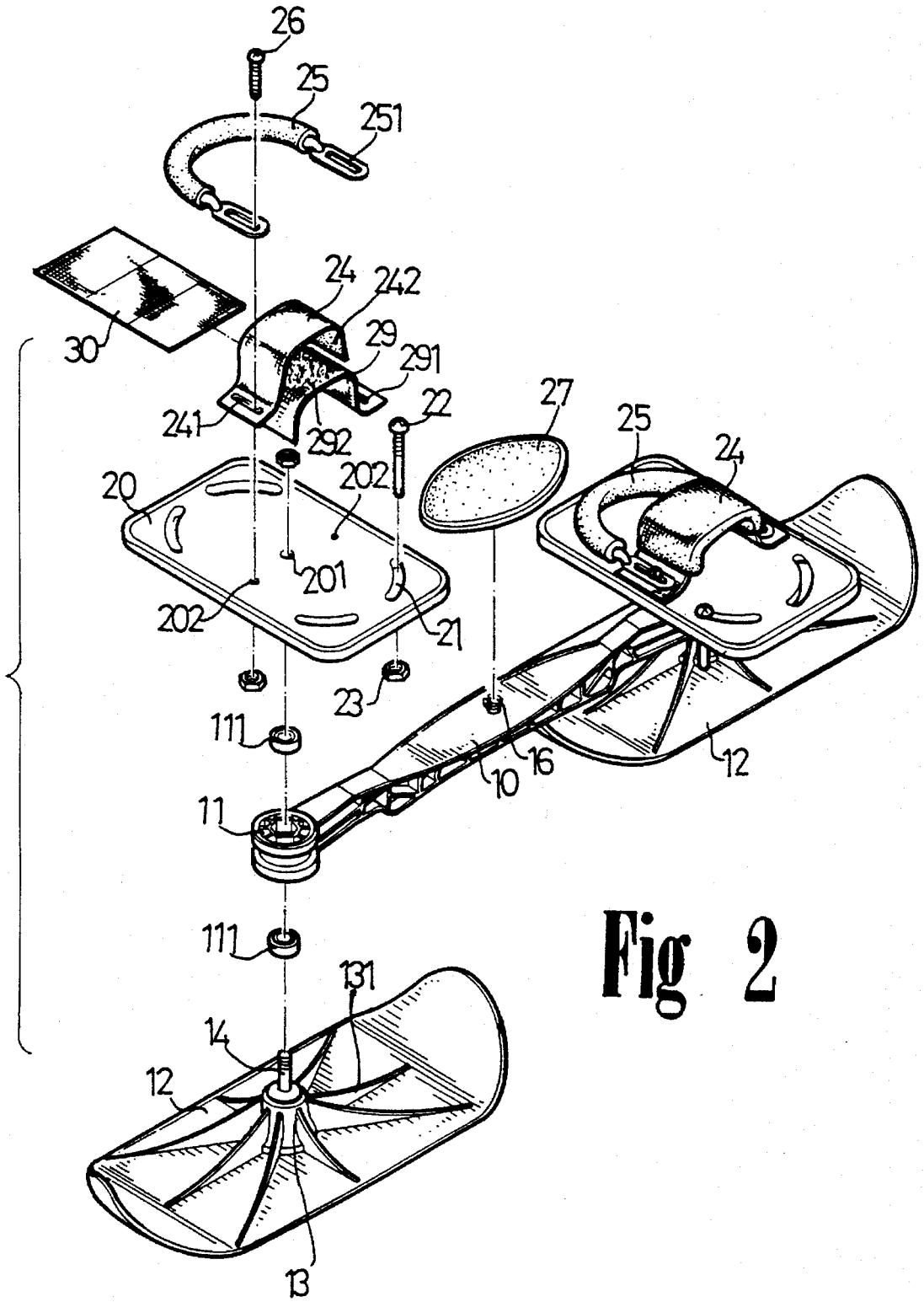
FIG. 2 is an exploded view of the ski board combination.
Figure 3:
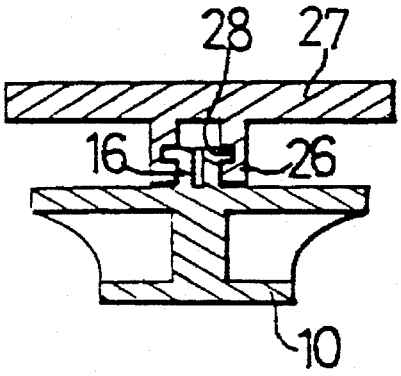
FIG. 3 is a cross sectional view taken along lines 3–3 of FIG. 1.

As best shown in FIG. 3, a resilient chuck or retaining means 16 is provided on the middle portion of the beam 10 for engaging with the annular slot 28 of a hub 26 which is secured to the bottom portion of an auxiliary foot support 27. The auxiliary foot support 27 is secured to the retaining means 16 by force-fitted engagement such that the auxiliary foot support 27 may be retained in suitable position relative to the beam 10 by the retaining means 16 and may be rotated relative to the retaining means 16 against the resilient force of the retaining means 16 applied to the hub 26.

Accordingly, the ski board combination includes two foot supports 20 and two ski boards 12 that are rotated in concert and that may be rotated freely and that may be limited to rotate within suitable angles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ski board combination comprising:

a beam including two ends each having a hub provided thereon, and including a middle portion, a pair of ski boards each including a shaft extended upward therefrom and engaged upward through one of said hubs so as to allow free rotation of each of said ski boards in its respective hub, and a pair of first foot supports each secured on top of one of said shafts respectively and rotated in concert each with its respective shalt, said first foot supports each of which includes at least one slot extending therethrough, and each of said slots includes stop means engaged in said slot for engaging with said beam so as to limit rotational movement of said first foot supports.

2. A ski board combination according to claim 1, wherein said first foot supports each includes an upwardly arched toe stirrup and a rearwardly arched heel stop secured thereon.

3. A ski board combination according to claim 2 further comprising an inner layer engaged with said upwardly arched toe stirrup, means for securing said inner layer to said upwardly arched toe stirrup, and an outer layer engaged around said inner layer and said upwardly arched toe stirrup for further solidly securing said inner layer to said upwardly arched toe stirrup.

* * * * *